United States Patent [19]

Lasauskas et al.

[11] Patent Number: 4,656,939

[45] Date of Patent: Apr. 14, 1987

[54] PRINTER AND INKER ARRANGEMENT FOR MARKING CONVEYED ARTICLES

[76] Inventors: Patrick Lasauskas, 808 Waterford Cir.; Daniel R. Tobin, 716 Jane's View, both of, Papillion, Nebr. 68046

[21] Appl. No.: 317,238

[22] Filed: Nov. 2, 1981

[51] Int. Cl.[4] ..... B41F 17/26

[52] U.S. Cl. ..... 101/35; 101/329; 101/395; 101/415.1

[58] Field of Search ..... 101/35–37, 101/329, 415.1, 395

[56] References Cited

U.S. PATENT DOCUMENTS

| | | | |
|---|---|---|---|
| 875,092 | 12/1907 | Merrell | 101/35 |
| 2,909,991 | 10/1959 | Farkas | 101/35 |
| 2,952,204 | 9/1960 | Sherman | 101/35 |
| 3,568,596 | 3/1971 | Mashburn | 101/415.1 |
| 3,648,601 | 3/1972 | Weidman | 101/35 |
| 3,727,547 | 4/1973 | Wilde | 101/35 |
| 3,735,697 | 5/1973 | Provan | 101/37 |
| 3,738,260 | 6/1973 | Navi et al. | 101/35 |
| 3,786,746 | 1/1974 | Roberts | 101/35 |
| 3,808,970 | 5/1974 | Delligatti | 101/35 |
| 3,858,510 | 1/1975 | Kai et al. | 101/395 |
| 3,863,564 | 2/1975 | Higuchi | 101/35 |
| 4,000,690 | 1/1977 | Geurtsen et al. | 101/35 X |
| 4,193,343 | 3/1980 | Ackley, Sr. et al. | 101/35 |
| 4,263,845 | 4/1981 | Okamura | 101/35 |

FOREIGN PATENT DOCUMENTS

| | | | |
|---|---|---|---|
| 464379 | 1/1914 | France | 101/35 |

*Primary Examiner*—Clifford D. Crowder

*Attorney, Agent, or Firm*—Zarley, McKee, Thomte, Voorhees & Sease

[57] ABSTRACT

A marking device is disclosed which is capable of printing on the lower surface of a package as it passes over a conveyor belt. Multiple inking wheels and multiple printer wheels removably mounted on parallel shafts in a slidingly removable unit are described. The marking device employs an adjustment unit for adjusting the height of the slide-out unit with respect to a surface to be marked and a second adjustment unit for adjusting the position of inking wheels with respect to printer wheels. An improved printer wheel and inking strip is also disclosed.

8 Claims, 6 Drawing Figures

PRINTER AND INKER ARRANGEMENT FOR MARKING CONVEYED ARTICLES

BACKGROUND OF THE INVENTION

The present invention deals generally with marking devices and more specifically with revolving printing devices which are used for marking packages, labels and the like.

Before manufactured goods reach an ultimate user, they are passed through a number of intermediate handlers, including wholesale distributors, retail distributors and various shipping and freight companies. Each handler generally is responsible for the goods while it is in his possession and often utilize a marking system for identifying goods as they are received. The marking system may also serve the function of identifying goods that have been handled by particular personnel within a company for the purpose of internal control over work quality.

In a typical marking system, the packages to be marked pass along a conveyor belt and are marked by an apparatus which is mounted at the side of the conveyor belt. Conventional marking devices of this type employ a revolving printer wheel and a revolving inking wheel in contact with the printer wheel. The printer wheel and inking wheel are mounted on a single arm which is in turn pivotally mounted on a vertical shaft at the side of the conveyor belt. The device prints a coded message contained on the printer wheel when the lateral side of the box makes frictional contact with the printer wheel. The arm of the device is generally spring loaded to urge the wheel against the side of the box to ensure sufficient pressure for printing. Other similar devices for marking the tops of packages are also available. Top marking devices are mounted on a horizontal arm positioned above the package to be printed. Both system have proven to be quite effective for marking boxes of a uniform size. However, problems have been encountered when boxes of multiple sizes and weights are passed along a single conveyor system. The problems result due to the fact that the surfaces of the packages to be marked are positioned at varying distances from the pivot arm of the marker. This difference in distances causes problems with the printer wheels making contact with the box and also causes problems with the printing pressure to be applied to a box after contact is made. The bottom mounted device of the present invention solves these problems.

In some applications existing marking systems are not desirable for ascetic reasons. In these situations, it would improve the appearance of the package to mark it on the bottom, rather than the top or side. The most convenient place for mounting a bottom marking device would be the space between two conveyor belts. However, space requirements of present marking systems generally make such mounting unpractical.

From the above it may be seen that a need exists for an improved marking device capable of printing on the bottom of packages. The device should be able to mark packages as they are transferred between conveyor belts. The system should also be capable of marking boxes of varying sizes and weights. Finally, the system should be of a narrow width to accomodate limited space requirements and should be easily removable for re-inking and routine maintenance.

SUMMARY OF THE INVENTION

The present invention is a revolving marking device which may be mounted at the end of a conveyor belt or in the narrow space between conveyor belts. Accordingly, it is an object of the invention to provide a marking system to be used in conjunction with a conveyor.

It is a further object of the present invention to provide a marking system which will print on the bottom of a container.

It is a further object of the present invention to provide a marking system which has multiple print wheels containing redundant information to ensure marking of various sized containers.

It is a further object of the present invention to provide a marking system which utilizes the weight of a container to be marked to provide proper pressure for printing.

It is a further object of the present invention to provide a marking system which obviates the need to align containers on a conveyor belt.

It is a further object of the present invention to provide a marking system which is constructed in a slidingly removable unit which is easily serviced and maintained.

It is a further object of the present invention to provide a marking system which is provided with radially adjustable print wheels and inking wheels.

It is a further object of the present invention to provide a marking system which may be adjusted in height with respect to a conveyor belt.

It is a further object of the present invention to provide a marking system in which the ink wheels may be adjusted in height with respect to the print wheels to ensure adequate frictional contact as ink is depleted from the ink wheels.

It is a further object of the present invention to provide a marking system in which the ink wheels are provided with sleeves to facilitate inking, handling and spacing.

It is a further object of the present invention to provide a marking system in which the printer wheels and inking wheels are mounted on separate parallel shafts.

It is a further object of the present invention to provide a marking system in which printing type is mounted on a flat-backed photopolymer resin to improve the cleaning and marking operations of the system.

It is a further object of the present invention to provide a marking system in which the print wheels upon which the photopolymer mat is mounted has a flat, relatively deep mounting surface.

It is a further object of the present invention to provide a marking system which is inexpensive to produce.

It is a further object of the present invention to provide a marking system which may be used to mark packaging tape to prevent or identify theft by subsequent handlers.

It is a still further object of the invention to provide a marking system to be used in conjunction with a gravity conveyor.

DESCRIPTION OF THE PREFERRED EMBODIMENTS

Figure 1:
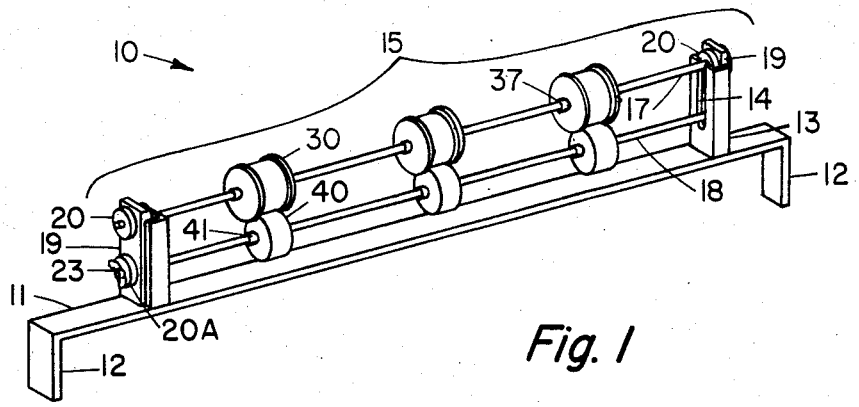
FIG. 1 is a perspective view of a marking device.
Figure 2:
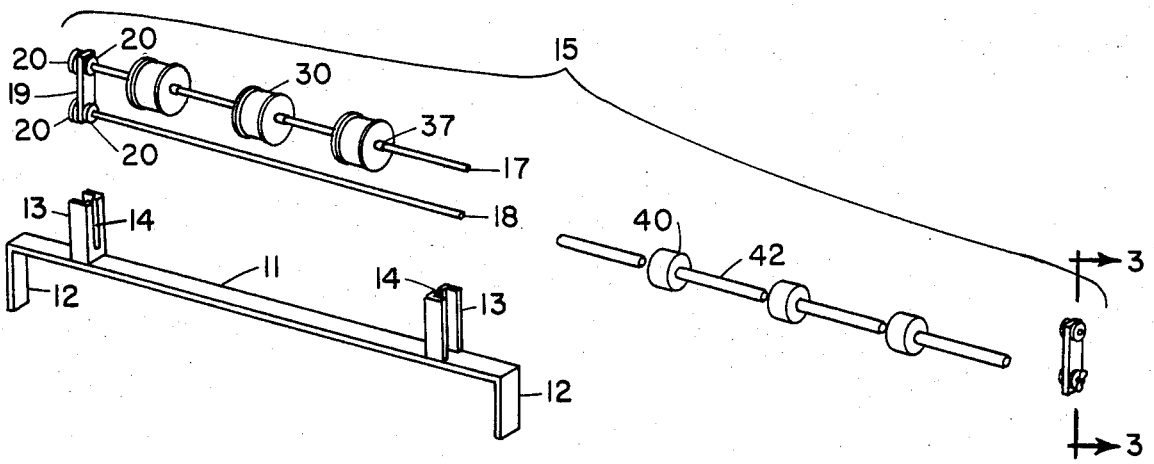
FIG. 2 is an exploded perspective view of a marking device.

As shown by FIGS. 1 and 2, the marking device 10 of the present invention consists of an operating unit 15 which is slidably mounted in a fixed bracket 11. The bracket 11 is formed from an elongate horizontal bar. The bar has right angle bends a few inches from each end which form vertical legs 12. Two vertical bracket arms, each with a vertical slot 14, are mounted on the upper surface near either end of the bracket 11 by welding or other rigid attachment means.

Figure 5:
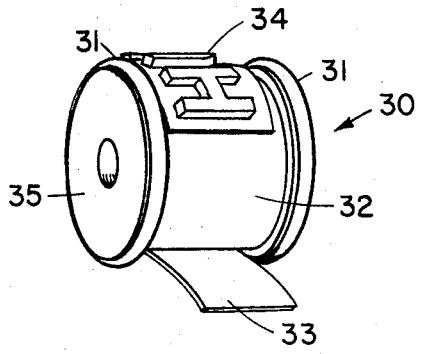
FIG. 5 is a perspective detail view of a printer wheel and print strip.

The sliding unit 15 of the invention will now be described with reference to FIGS. 1 and 2. The sliding unit 15 contains two parallel axle shafts 17, 18 which are maintained in spaced parallel position by two end posts 19. Each end post 19 is a metal plate which has a hole in the upper end adapted to accept the upper shaft 17. Removable collars 20 positioned on either side of the end posts 19 prevent linear displacement of the upper shaft 17 with respect to the end posts 19. Three freely rotating printer wheels 30 are mounted on the upper shaft 17 and are held in position by removable collars 37 which are positioned at either side of each printer wheel 30. As shown by FIG. 5, a printer wheel 30 has two raised outer rims 31 which extend radially from its lateral sides 35. The inner portion of the wheel periphery 32 is a smooth metal surface upon which a print strip 33 is mounted. Unlike printer wheels presently in use, the printer wheel 30 of the present invention does not have a raised ribbed surface for holding a similarly ribbed print strip. Rather, the peripheral attachment surface 32 is smooth to accept a smooth-backed print strip 33. In the preferred embodiment, the print strip 33 is composed of a photopolymer resin. An attachment device (not shown) such as velcro or the like is provided at the ends of the strip 33 for securing it to the printer wheel 30. Printing characters 34, mounted on the exterior surface of the strip 33, protrude slightly above the uppermost surface of the outer rims 31. The printing characters 34 thus contact and mark a box or other item which rolls over the printing wheel 30. The use of low profile flat surfaces on the wheel periphery 32 and printing strip 33 rather than raised, intermeshing ribbed surfaces allows the printing characters 34 to be raised farther above the strip 33 surface than conventional characters. The increased height of the characters 34 prevents them from clogging with ink, dust, and other debris which tends to build up on the strip 33. The flat surface design also eliminates cleaning problems associated with the ribbed attachment surfaces presently used on conventional printing wheels. Finally, the photopolymer resin material has improved cleaning characteristics over conventional material which greatly facilitates routine maintenance of the system.

Figure 4:
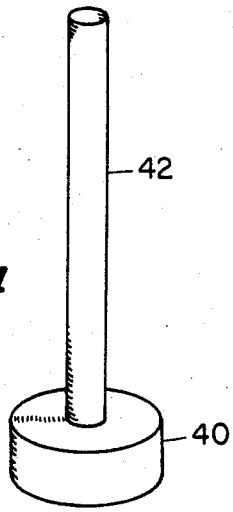
FIG. 4 is a perspective detail view of an inking wheel and inking wheel sleeve.
Figure 3:
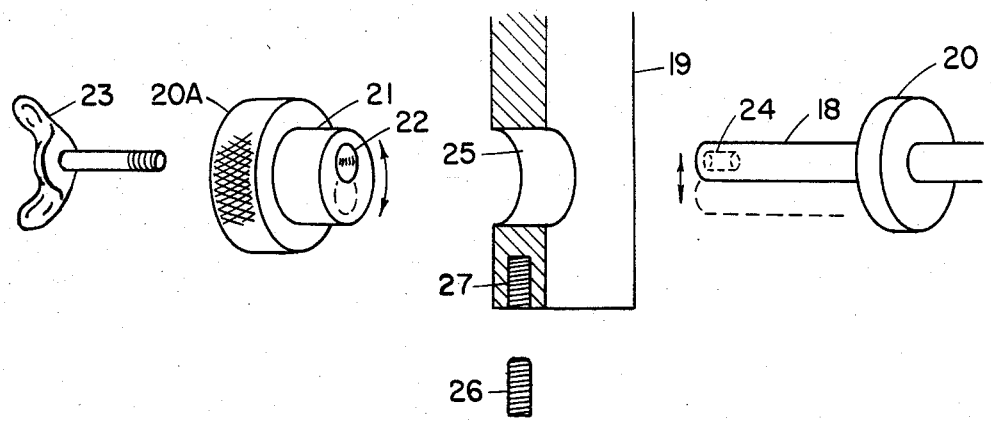
FIG. 3 is an exploded cutaway detail view of an inking wheel shaft mounting assembly for a marking device.

Inking wheels 40 composed of absorbent fabric or other ink absorbing material well known in the art are mounted on the lower shaft 18 immediately below the printer wheels 30. The inking wheels 40 may be held in position by removable collars 41, as shown in FIG. 1, or may be mounted on sleeves 42 attached to one side of the inking wheel 40, as shown by FIGS. 2 and 4. The use of sleeves 42 facilitates the removal and re-inking of the inking wheels 42 by providing a handle which a person may hold while dipping the wheel 40 in an ink bath (not shown). The attachment of the lower shaft 18 to the end posts 19 is shown by FIG. 3. It may be seen that an inner collar 20 is affixed to the shaft to prevent inboard movement of the end post 19 with respect to the shaft. An outer collar 20(A) is provided with a cylindrical projection 21 which fits in close sliding contact with an aperture 25 provided in the lower end of the end post 19. An eccentric hole 22 passing axially through the protruding portion of the outer collar 20(A) slideingly accepts an end of the lower shaft 18. A threaded axial hole 24 at the end of the lower shaft 18 is adapted to accept a wing screw 23. The wing screw 23 passes through a smaller hole in the outer portion of the outer collar (not shown) which is co-axial with the eccentric hole 22. Thus, it may be seen that by turning the outer collar 20A about its axis the eccentric hole 22 will be displaced upwards or downwards, thus raising or lowering the end of the lower shaft 18. This arrangement is utilized to facilitate inking which requires the inking wheel 40 to be in constant frictional contact with the print wheel 30. As ink is depleted from an inking wheel 40, the radius of the wheel tends to shrink, thus requiring periodic adjustment of the distance between the inking wheel 40 and the printer wheel 30. It may be seen that by using the described arrangement, the lower axis 18 may be moved closer to the upper axis 17 by simply turning the outer collars 20A. It may be seen from FIG. 3 that a set screw 26 is provided in a threaded hole 27 at the base of each end post 19. The set screw allows the height of the slide-out unit 15 to be adjusted to ensure proper contact of the print strip 33, 34 with an item to be marked.

Figure 6:
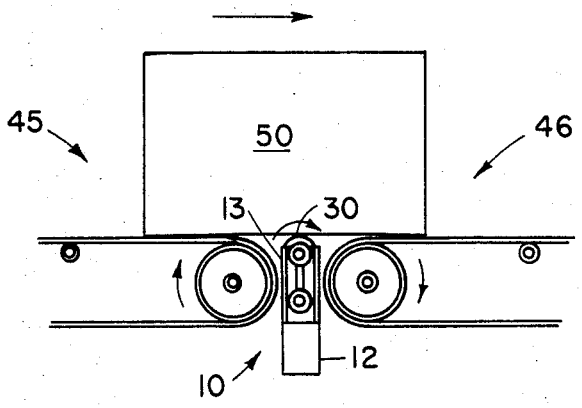
FIG. 6 is an elevation view showing the operation of a marking device mounted between two conveyor belts.

The operation of the marking device 10 will now be described. It may be seen from FIG. 6 that the marking device 10 is mounted in the narrow space between two conveyor belt systems 45, 46. The drawing illustrates a typical commercial situation in which goods are being transported from the conveyor belt 45 of a truck onto the conveyor belt 46 of a warehouse or processing area. As an item, such as a box 50, passes from one conveyor belt 45 to the other 46 it passes over one or more of the printer wheels 30. As the box contacts the printer wheel 30 the friction between the wheel 30 and the box 50 causes the wheel 30 to rotate. The printing characters 34, which protrude slightly above the outer rims 31, contact the box 50 and print on its lower surface as it rolls across the wheel 30. Simultaneously, the inking wheel 40 contact the lower surface of the printer wheel 30, thus re-inking the characters 34 as the wheels 30, 40 turn.

An advantage of this system over present systems is that the weight of the box 50 is used to provide frictional contact with the print wheel 30, thus obviating the need for a spring or other biasing device. Each wheel in the preferred embodiment carries the same information; thus the bottom of a large box 50 will be marked three times, whereas, the bottom of a small box 50 may be marked only once. However, the purpose of providing wheels 30 with redundant information is to assure that every box 50 which passes along the conveyor system 45 will be marked at least once. This represents a great improvement over side marking systems which encounter problems handling boxes of different sizes. Another advantage of the present invention is that boxes may be placed on a conveyor system 45 in any orientation without causing malfunction in the marking system, a feature which few side marking systems can duplicate. Where it is desired, a dividing system might also be placed on the conveyor belt 45, thus allowing packages of different categories to be passed along the same conveyor belt 45 and marked by separate printer wheels 30 containing different coding information. The vertical orientation of the present invention 10 allows it to fit in the narrow space between conveyors 45, 46 where it will not interfere with other assembly line operations. Finally, the slide-out unit 15 may be easily removed from the bracket and disassembled for routine maintenance.

Obviously, many modifications and variations of the present invention are possible in light of the above teaching. It is therefore to be understood that, within the scope of the appended claims, the invention may be practiced otherwise than as specifically described.

We claim:

1. A marking device for marking items passing along a conveyor surface, comprising a printer wheel shaft means, an inking wheeel shaft means oriented parallel to said printer wheel shaft means, a printer wheel means mounted on said printer wheel shaft means and having an outer peripheral printing surface, an inking wheel means mounted on said inking wheel shaft means, means for mounting said printer wheel shaft means proximate to and below said conveyor surface such that the uppermost portion of the outer peripheral printing surface of said printer wheel means is positioned generally in the plane of said conveyor surface, thereby to printingly contact the bottom surface of items passing along the conveyor surface, said printer wheel means being freely rotatably supported whereby said printer wheel means is rotated by frictional engagement with the bottom surface of an item conveyed thereover, means for mounting said inking wheel shaft means for rolling frictional contact between said inking wheel means and printer wheel means for delivering ink to said printer wheel means, said printer wheel means comprising a plurality of printer wheels, said printer wheels being selectively positionable on said printer wheel shaft means, said inking wheel means comprising a plurality of inking wheels, each printer wheel being in contact with a separate inking wheel, said marking device being mounted at the discharge end of the conveyor surface, said printer wheel shaft means being positioned above said inking wheel shaft means and wherein the longitudinal axis of said wheel shaft means are positioned perpendicular to the direction of movement of items on said conveyor surface, said printer wheel means comprising removable print strips mounted on said printer wheels and wherein said print strips protrude slightly above the outermost surface of said printer wheels whereby an item passing over said printer wheels is placed in moving frictional contact with said print strips, and said mounting means comprising two end posts for holding said two shaft means in parallel alignment and bracket means mounted on the support structure of the conveyor surface adapted to slidingly accept said two end posts whereby a unit comprising said two shaft means, said two end posts, said printer wheels and said inking wheels is slideably removable from said bracket means.

2. The marking device of claim 1 wherein said bracket means comprises two vertically oriented end plates with a vertical slot in each end plate for slidingly engaging said two shaft means.

3. The marking device of claim 2 wherein said two shaft means are selectively removable from said two end posts.

4. The marking device of claim 3 wherein said printer wheels are selectively removable from said printer wheel shaft means and wherein said inking wheels are selectively removable from said inking wheel shaft means.

5. The marking device of claim 4 further comprising first adjustment means for adjusting the height of said printer wheels with respect to the conveyor surface.

6. The marking device of claim 5 further comprising second adjustment means for adjusting the height of said inking wheels with respect to said printer wheels.

7. The marking device of claim 6 wherein said printing strip comprises a flat backed strip formed from a photopolymer resin.

8. The marking device of claim 6 wherein said device is mounted between two conveyor surfaces.

* * * * *